US008037939B2

(12) United States Patent
Poirette et al.

(10) Patent No.: US 8,037,939 B2
(45) Date of Patent: Oct. 18, 2011

(54) RISER PIPE WITH RIGID AUXILIARY LINES

(75) Inventors: Yann Poirette, Lyons (FR); Gérard Papon, Les Essarts le Roi (FR); Jean Guesnon, Chatou (FR)

(73) Assignee: Institut Francais du Petrole, Cedex (FR)

( * ) Notice: Subject to any disclaimer, the term of this patent is extended or adjusted under 35 U.S.C. 154(b) by 0 days.

(21) Appl. No.: 12/089,252

(22) PCT Filed: Oct. 4, 2006

(86) PCT No.: PCT/FR2006/002295

§ 371 (c)(1), (2), (4) Date: Aug. 18, 2008

(87) PCT Pub. No.: WO2007/039688

PCT Pub. Date: Apr. 12, 2007

(65) Prior Publication Data

US 2009/0166043 A1 Jul. 2, 2009

(30) Foreign Application Priority Data

Oct. 4, 2005 (FR) ..... 05 10101

(51) Int. Cl.
*E21B 17/01* (2006.01)
*E21B 17/02* (2006.01)

(52) U.S. Cl. ..... 166/367; 166/339; 166/341; 166/344; 166/351; 166/378; 285/377; 285/361; 285/362; 285/402

(58) Field of Classification Search ..... 166/350–352, 166/355, 367, 339, 341, 344, 378, 77.51, 166/85.1; 405/224.2–224.4; 450/224.4; 285/377, 361, 362, 402, 396
See application file for complete search history.

(56) References Cited

U.S. PATENT DOCUMENTS

| | | | | |
|---|---|---|---|---|
| 3,189,098 | A * | 6/1965 | Haeber | 166/352 |
| 4,043,575 | A * | 8/1977 | Roth | 285/90 |
| 4,078,605 | A * | 3/1978 | Jones | 166/359 |
| 4,097,069 | A * | 6/1978 | Morrill | 285/84 |
| 4,280,719 | A | 7/1981 | Daniel et al. | |
| 4,330,140 | A * | 5/1982 | Hampton | 285/39 |
| 4,491,346 | A | 1/1985 | Walker | |
| 4,496,173 | A * | 1/1985 | Roche et al. | 285/24 |
| 4,514,254 | A | 4/1985 | Klepner | |
| 4,550,936 | A * | 11/1985 | Haeber et al. | 285/26 |
| 4,662,785 | A * | 5/1987 | Gibb et al. | 405/195.1 |
| 4,712,620 | A * | 12/1987 | Lim et al. | 166/355 |
| 5,220,961 | A * | 6/1993 | Guesnon et al. | 166/367 |
| 5,441,311 | A * | 8/1995 | Watkins | 285/18 |

(Continued)

FOREIGN PATENT DOCUMENTS

DE 28 33 866 2/1980

(Continued)

*Primary Examiner* — Thomas Beach
*Assistant Examiner* — Matthew Buck
(74) *Attorney, Agent, or Firm* — Antonelli, Terry, Stout & Kraus, LLP.

(57) ABSTRACT

The invention relates to a riser pipe section comprising a main tube (2), at least one auxiliary line element (3) arranged substantially parallel to said tube (2), characterized in that the ends of main tube (2) comprise connecting means (8) allowing longitudinal stresses to be transmitted and in that the ends of auxiliary line element (3) comprise linking means (5-6) allowing longitudinal stresses to be transmitted.

16 Claims, 2 Drawing Sheets

U.S. PATENT DOCUMENTS

| | | | | |
|---|---|---|---|---|
| 5,634,671 | A * | 6/1997 | Watkins | 285/18 |
| 5,657,823 | A * | 8/1997 | Kogure et al. | 166/340 |
| 5,992,893 | A | 11/1999 | Watkins | |
| 6,330,918 | B1 * | 12/2001 | Hosie et al. | 166/341 |
| 6,401,825 | B1 * | 6/2002 | Woodrow | 166/350 |
| 6,415,867 | B1 * | 7/2002 | Deul et al. | 166/367 |
| 6,419,277 | B1 * | 7/2002 | Reynolds | 285/123.1 |
| 6,530,430 | B2 * | 3/2003 | Reynolds | 166/346 |
| 6,623,044 | B1 * | 9/2003 | Guesnon et al. | 285/124.1 |
| 6,837,311 | B1 * | 1/2005 | Sele et al. | 166/353 |
| 6,869,253 | B2 * | 3/2005 | Biolley | 405/224.3 |
| 7,210,531 | B2 * | 5/2007 | van Belkom | 166/367 |
| 7,568,861 | B2 * | 8/2009 | Godoy et al. | 405/211 |

FOREIGN PATENT DOCUMENTS

| | | |
|---|---|---|
| FR | 2 432 672 | 2/1980 |
| FR | 2 464 426 | 3/1981 |
| FR | 2 526 517 | 11/1983 |
| FR | 2 799 789 | 4/2001 |
| FR | 2 828 121 | 2/2003 |
| FR | 2 828 262 | 2/2003 |

* cited by examiner

RISER PIPE WITH RIGID AUXILIARY LINES

FIELD OF THE INVENTION

The present invention relates to the field of very deep sea drilling and oil field development. It concerns a riser pipe element comprising at least one line, or rigid auxiliary line, which can transmit tensional stresses between the base and the top of the riser.

BACKGROUND OF THE INVENTION

A drilling riser is made up of an assembly of tubular elements whose length ranges between 15 and 25 m, assembled by connectors. The weight of these risers borne by an offshore platform can be very great, which requires suspension means of very high capacity at the surface and suitable dimensions for the main tube and the linking subs.

So far, the auxiliary lines: kill lines, choke lines, booster lines and hydraulic lines are arranged around the main tube and they comprise subs that fit together, fastened to the riser element connectors in such a way that these high-pressure lines can allow a longitudinal relative displacement between two successive line elements, without any disconnection possibility however. Owing to these elements mounted sliding into one another, the lines intended to allow high-pressure circulation of an effluent coming from the well or from the surface cannot take part in the longitudinal mechanical strength of the structure consisting of the entire riser.

Now, in the perspective of drilling at water depths that can reach 3500 m or more, the dead weight of the auxiliary lines becomes very penalizing. This phenomenon is increased by the fact that, for the same maximum working pressure, the length of these lines requires a larger inside diameter considering the necessity to limit pressure drops.

Document FR-2,799,789 aims to involve the auxiliary lines, kill lines, choke lines, booster lines or hydraulic lines, in the longitudinal mechanical strength of the riser. According to this document, a riser element comprises a main tube, connecting means at both ends thereof, at least one auxiliary line length arranged substantially parallel to the main tube. The auxiliary line length is secured at both ends to the main tube connecting means so that the longitudinal mechanical stresses undergone by the connecting means are distributed in the tube and in the line.

One difficulty in making the riser according to document FR-2,799,789 lies in the fastening means for joining the auxiliary line length to the main tube. The tensional stresses undergone by the auxiliary line length are transmitted by these fastening means. The assembly and design requirements impose a distance to be provided between the main tube and the auxiliary line. This distance acts as a lever arm for the tensional stresses transmitted to the auxiliary line. As a result of the tensional stresses associated with the lever arm, the fastening means are subject to bending strains that may be harmful to the good working order of the riser.

The present invention provides a riser made according to a principle that is an alternative to the principle disclosed by document FR-2,799,789. According to the present invention, all of the auxiliary lines contribute, together with the main tube, to taking up the longitudinal stresses applied to the riser.

SUMMARY OF THE INVENTION

In general terms, the invention relates to a riser section comprising a main tube, at least one auxiliary line element arranged substantially parallel to said tube, characterized in that the ends of the main tube comprise connecting means allowing longitudinal stresses to be transmitted and in that the ends of the auxiliary line element comprise linking means allowing longitudinal stresses to be transmitted.

According to the invention, the auxiliary line element can be secured to the main tube. The connecting means can consist of a bayonet locking system. The linking means can be selected from among the group consisting of a bayonet locking system and a screwing system.

The connecting means can comprise a first rotating locking element, wherein the linking means can comprise a second rotating locking element, and wherein rotation of the first locking element can cause rotation of the second locking element.

The bayonet locking system can comprise a male tubular element and a female tubular element that fit into one another and have an axial shoulder for longitudinal positioning of the male tubular element in relation to the female tubular element, a locking ring mounted mobile in rotation on one of the tubular elements, the ring comprising studs that co-operate with the studs of the other tubular element so as to form a bayonet joint.

According to the invention, the main tube can be a steel tube hooped by composite reinforcing strips. The auxiliary line element can be a steel tube hooped by composite reinforcing strips. The composite reinforcing strips can be made of glass fibers, carbon fibers or aramid fibers coated with a polymer matrix.

The invention also relates to a riser comprising at least two riser sections, as described above, assembled end to end, wherein an auxiliary line element of a section transmits longitudinal stresses to the auxiliary line element of the other section to which it is joined.

BRIEF DESCRIPTION OF THE FIGURES

Other features and advantages of the invention will be clear from reading the description hereafter, with reference to the accompanying figures wherein.

DETAILED DESCRIPTION

Figure 1:
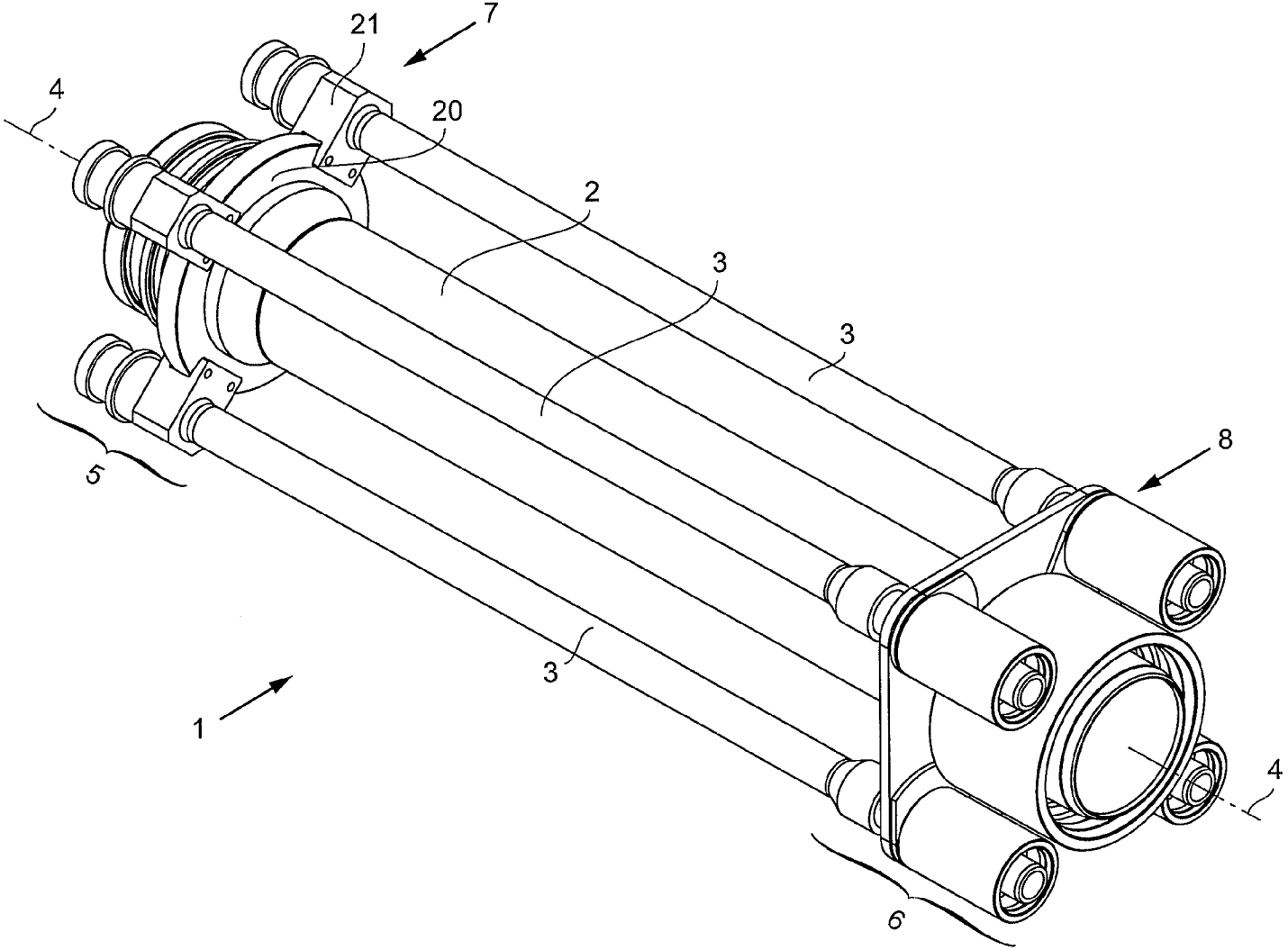
FIG. 1 shows a riser section.

FIG. 1 shows a section 1 of a riser pipe. Section 1 is provided, at one end thereof, with female connecting means 5 and, at the other end, with male connecting means 6. To form a riser, several sections 1 are assembled end to end using connecting means 5 and 6.

Riser section 1 comprises a main tube element 2 whose axis 4 is the axis of the riser. The auxiliary lines or pipes are arranged parallel to axis 4 of the riser so as to be integrated in the main tube. Reference numbers 3 designate each one of the auxiliary line elements. The length of elements 3 is substantially equal to the length of main tube element 2. At least one line 3 is arranged on the periphery of main tube 2. The lines are preferably arranged symmetrically around tube 2 so as to balance the load transfer of the riser. These lines, referred to as kill lines, choke lines, are used to provide well safety during control procedures intended to check the inflow of fluids under pressure in the well. The booster line allows mud to be injected. The hydraulic line allows the blowout preventer, commonly referred to as B.O.P., to be controlled at the wellhead.

According to the invention, the female 5 and male 6 connecting means consist of several connectors: main tube element 2 and each auxiliary line element 3 are each provided with a mechanical connector. These mechanical connectors allow longitudinal stresses to be transmitted from one element to the next. For example, the connectors can be of the type described in documents FR-2,432,672, FR-2,464,426 and FR-2,526,517. These connectors allow two tube sections to be assembled together. A connector comprises a male tubular element and a female tubular element that fit into one another and have an axial shoulder for longitudinal positioning of the male tubular element in relation to the female tubular element. The connector also comprises a locking ring mounted mobile in rotation on one of the tubular elements. The ring comprises studs that co-operate with the studs of the other tubular element so as to form a bayonet joint.

Alternatively, the mechanical connectors of auxiliary line elements 3 can also be conventional screwed and bolted joints. These connectors can also be "dog" connectors, i.e. using radial locks.

To simplify assembly of riser sections 1, connecting means 6 are provided with a locking system that allows the various connectors to be locked by actuating a single part. On the one hand, the periphery of the locking ring of the connector of main tube 2 is fitted with a toothed crown. On the other hand, the locking rings of each connector of auxiliary line elements 3 are fitted with toothed sectors that co-operate with the toothed crown of the connector of main tube 2. Thus, when rotating the ring of the connector of the main tube around axis 4, the toothed crown gears each one of the toothed sectors and thus causes rotation of each ring of the connectors of auxiliary line elements 3. This system allowing simultaneous locking of the connector of tube 2 with the connectors of elements 3 can be applied to any type of connector using a rotating locking system.

Furthermore, auxiliary line element 3 is secured to main tube 2. In other words, riser section 1 comprises a fastening means 7 allowing auxiliary line element 3 to be mechanically fastened to main tube 2. Fastening means 7 positions and secures element 3 onto tube 2. For example, fastening means 7 is located at the end of section 1 provided with female connecting means 5. For example, main tube 2 comprises a projecting crown 20 and auxiliary line element 3 comprises a member 21 fitted with a groove. Element 3 is mounted on tube 2 in such a way that projecting crown 20 lodges itself in the groove. Screws running through member 21 and the projecting crown secure element 3 to tube 2.

Elements 3 can be guided, for example, at the end provided with male connecting means 6, by guide means 8. Main tube 2 is fitted with a flange comprising a cylindrical passage wherein auxiliary line element 3 can slide. This cylindrical passage allows elements 3 to be guided.

Figure 2:
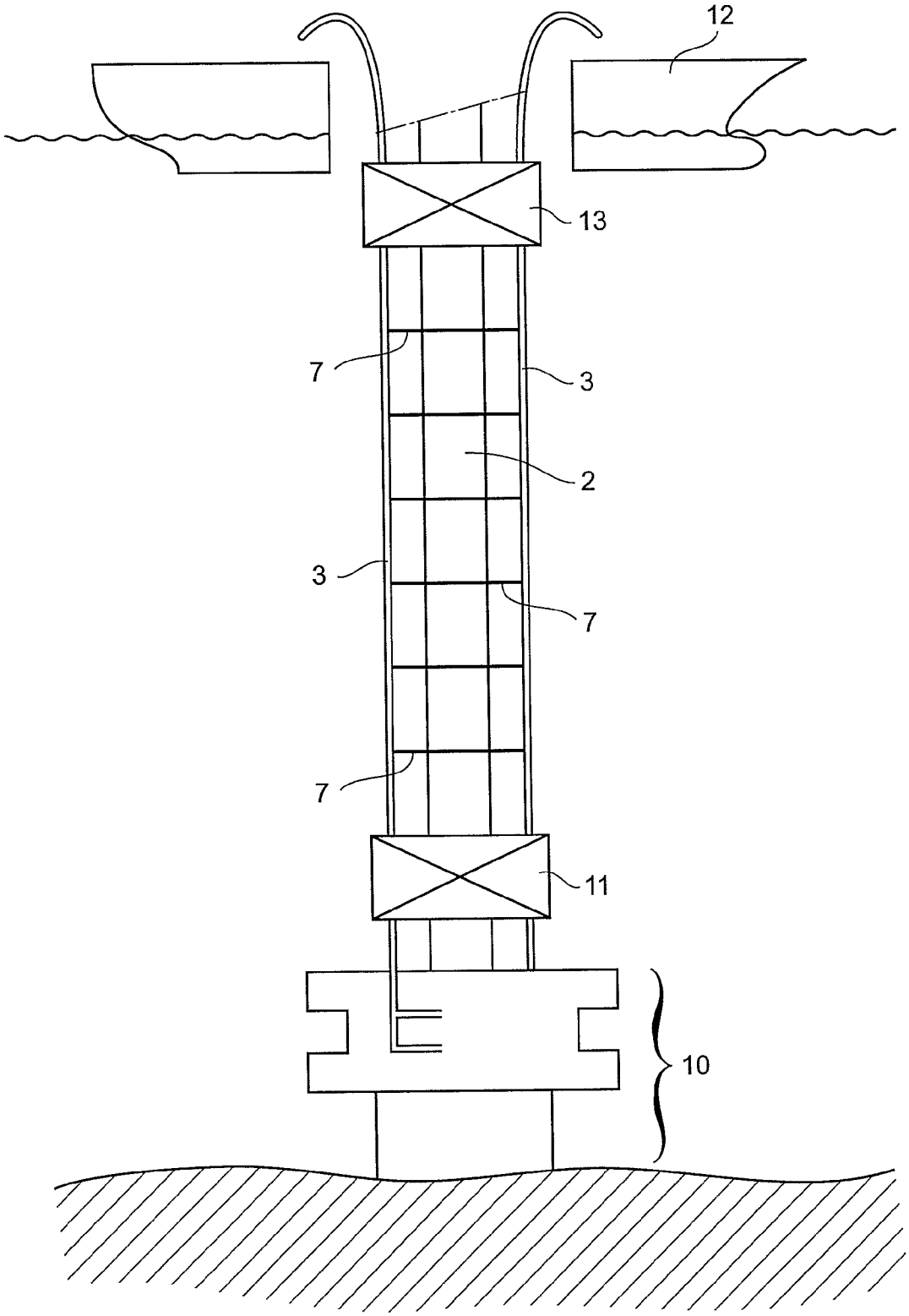
FIG. 2 diagrammatically shows a riser.

The riser diagrammatically shown in FIG. 2 comprises a main tube 2 and auxiliary lines 3. The main tube and each auxiliary line 3 are connected to wellhead 10 by connectors 11 and to floater 12 by connectors 13, connectors 11 and 13 transmitting the longitudinal stresses from the riser to the wellhead and to the floater. Thus, sections 1 allow to make a riser wherein the main tube forms a mechanically rigid assembly bearing the longitudinal stresses between wellhead 10 and floater 12. Furthermore, according to the invention, each auxiliary line separately forms a mechanically rigid assembly that also bears the longitudinal stresses between wellhead 10 and floater 12. Consequently, the longitudinal stresses applied to the riser are distributed between main tube 2 and the various auxiliary lines 3.

Besides, at section 1, each auxiliary line element 3 is secured to the main tube by fastening means 7. These fastening means 7 are suited to distribute or to balance the stresses between the various auxiliary lines and the main tube, notably if the deformations between the lines and the main tube are not equal, for example in case of pressure variation between the various lines. Thus, the stresses and notably the tension undergone by the riser are distributed between the auxiliary lines and the main tube over the entire height of the riser, by multiplying said fastening means over this height.

By way of example, a riser according to the invention can have the characteristics as follows:

Main tube diameter: 21"

Auxiliary line diameter: 6"

Working pressure: 1050 bars

Tensional stresses exerted on the riser: 1000 tons.

Furthermore, in order to produce risers that can operate at depths reaching 3500 m and more, metallic tube elements are used, whose resistance is optimized by composite hoops made of fibers coated with a polymer matrix.

A tube hooping technique can be the technique consisting in winding under tension composite strips around a metallic tubular body, as described in documents FR-2,828,121, FR-2,828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very weak stress in the metallic tube. Then a predetermined pressure is applied to the inside of the metallic body so that the metallic body deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensional stresses.

The invention claimed is:

1. A riser comprising at least two riser sections assembled end to end, each of the riser sections comprising a main tube, at least one auxiliary line element arranged substantially parallel to said main tube, characterized in that the ends of main tube of each of the riser sections comprise connecting means allowing longitudinal tensional stresses to be transmitted from the main tube of one of the riser sections to the main tube of the other of the riser sections and in that the ends of auxiliary line element of each of the riser sections comprise linking means allowing longitudinal tensional stresses to be transmitted from the auxiliary line element of one of the riser sections to the auxiliary line element of the other of the riser sections, wherein the linking means comprises a male tubular element and a female tubular element that fit into one another and have an axial shoulder for longitudinal positioning of the male tubular element in relation to the female tubular element, a locking ring mounted mobile in rotation on one of the tubular elements, the locking ring comprising studs that cooperate with the studs of the other tubular element so as to form a bayonet joint.

2. A riser as claimed in, claim 1, wherein in each of the riser sections the auxiliary line element is secured to the main tube.

3. A riser as claimed in claim 1, wherein the connecting means consist of a bayonet locking system.

4. A riser as claimed in claim 1, wherein the connecting means comprise a first rotating locking element, and wherein rotation of the first locking element causes rotation of the locking ring of the linking means.

5. A riser as claimed in claim 3, wherein the bayonet locking system comprises a male tubular element and a female tubular element that fit into one another and have an axial shoulder for longitudinal positioning of the male tubular element in relation to the female tubular element, a locking ring mounted mobile in rotation on one of the tubular elements, the ring comprising studs that co-operate with the studs of the other tubular element so as to form a bayonet joint.

6. A riser as claimed in claim 1, wherein in each of the riser sections the main tube is a steel tube hooped with composite strips.

7. A riser as claimed in claim 1, wherein in each of the riser sections the auxiliary line element is a steel tube hooped with composite strips.

8. A riser as claimed in claim 6, wherein said composite strips comprise glass, carbon or aramid fibers coated with a polymer matrix.

9. A riser comprising at least two riser sections assembled end to end, each of the riser sections comprising a main tube, at least one auxiliary line element arranged substantially parallel to said main tube, a connector connecting adjacent ends of the main tubes of the at least two riser sections, the connector allowing longitudinal tensional stresses to be transmitted from the main tube of one of the riser sections to the main tube of an adjacent riser section, and a linking connector connecting adjacent ends of the auxiliary line elements of the at least two riser sections, the linking connector allowing longitudinal tensional stresses to be transmitted from the auxiliary line element of one of the riser sections to the auxiliary line element of the adjacent riser sections, wherein the linking connector comprises a male tubular element and a female tubular element that fit into one another and have an axial shoulder for longitudinal positioning of the male tubular element in relation to the female tubular element, a locking ring mounted mobile in rotation on one of the tubular elements, the locking ring comprising studs that cooperate with the studs of the other tubular element so as to form a bayonet joint.

10. A riser as claimed in claim 9, wherein in each of the riser sections the auxiliary line element is secured to the main tube.

11. A riser as claimed in claim 9, wherein the connector comprises a bayonet locking system.

12. A riser as claimed in claim 11, wherein the bayonet locking system comprises a male tubular element and a female tubular element that fit into one another and have an axial shoulder for longitudinal positioning of the male tubular element in relation to the female tubular element, a locking ring mounted mobile in rotation on one of the tubular elements, the ring, comprising studs that co-operate with the studs of the other tubular element so as to form a bayonet joint.

13. A riser as claimed in claim 9, wherein the connector comprises a first rotating locking element, and wherein rotation of the first locking element causes rotation of the locking ring of the linking means.

14. A riser as claimed in claim 9, wherein in each of the riser sections the main tube is a steel tube hooped with composite strips.

15. A riser as claimed in claim 14, wherein the composite strips comprise glass, carbon or aramid fibers coated with a polymer matrix.

16. A riser as claimed in claim 9, wherein in each of the riser sections the auxiliary line element is a steel tube hooped with composite strips.

* * * * *